United States Patent [19]

Venot

[11] 4,076,075

[45] Feb. 28, 1978

[54] YARN HEATING DEVICE

[75] Inventor: Jean Venot, Roanne, France

[73] Assignee: ASA S.A., Roanne, France

[21] Appl. No.: 699,713

[22] Filed: Jun. 25, 1976

[30] Foreign Application Priority Data

Jul. 10, 1975 France ..... 75.21797

[51] Int. Cl.[2] ..... F28D 15/00; H05B 3/00; F27B 9/08; D02J 13/00

[52] U.S. Cl. ..... 165/105; 165/185; 219/326; 219/341; 219/388; 28/217; 57/34 HS

[58] Field of Search ..... 165/105, 185; 28/62; 57/34 HS; 219/388 S, 326, 341

[56] References Cited

U.S. PATENT DOCUMENTS

| | | | |
|---|---|---|---|
| 3,395,433 | 8/1968 | Kodaira et al. | 165/105 X |
| 3,738,017 | 6/1973 | Raschle | 57/34 HS X |
| 3,879,599 | 4/1975 | Kodaira | 219/288 S X |
| 4,001,548 | 1/1977 | Bauer | 165/105 X |

*Primary Examiner*—Albert W. Davis, Jr.
*Attorney, Agent, or Firm*—Arnold, White & Durkee

[57] ABSTRACT

A yarn heating device comprising a lower vessel containing a heat transfer liquid and a heating device passing through said vessel over its entire length and intended to vaporize the heat transfer liquid, and an upper vessel connected to the lower vessel by a plurality of vertical conduits, through which pass treatment tubes of stainless steel or the like intended for the passage of the moving yarn, the upper part of the or each treatment tube being surrounded by a metal part which is a very good heat conductor.

10 Claims, 4 Drawing Figures

YARN HEATING DEVICE

The present invention relates to an improved device for the heat treatment of yarns, especially synthetic yarns.

Though, in the description which follows, the invention will be particularly described in its application to false-twist texturising, it is in no way restricted to this preferred embodiment.

The process of false-twist texturising is in itself well known and it is thus superfluous to describe it in detail. Essentially, this process consists of continuously overtwisting a thermoplastic yarn, heating this yarn in the twisted state, cooling it, untwisting it and, if appropriate, re-setting it, by heat, in the partially relaxed state.

The heating of a yarn by means of a heat transfer fluid has in itself also been well-known for a long time. The term "heat transfer fluid" is applied to a liquid which can be heated to a high temperature in order to transmit its heat to a body with which the yarn is in direct contact. Advantageously, this fluid consists of a liquid comprising a mixture, for example of diphenyl and diphenyl ether, in appropriate proportions. Such a mixture, sometimes referred to in the literature under the name "diphyl", is marketed under trade marks such as DOWTHERM, GILLIOTHERM and the like.

U.S. Pat. No. 2,761,272 has proposed heating the yarn which is to be texturised by passing it over a hollow curved metallic surface, inside which the hot heat transfer fluid circulates.

U.S. Pat. No. 2,874,410 has proposed using, in a drawing-orientation operation, a yarn heating device which consists essentially of a hollow finger which the heat transfer fluid enters no longer in a liquid form but in the form of a vapour.

French Pat. No. 1,379,716 (corresponding to U.S. Pat. No. 3,298,430) and British Pat. No. 1,141,874 have proposed employing the same means for heating metal tubes used as a twist-setting device in the false-twist process. Such a device essentially comprises a closed vessel containing a liquid heat transfer fluid at its bottom, a heating element immersed in the said heat transfer fluid and intended to vaporise this liquid so that the vapour fills the whole of the vessel and thus maintains the vessel at a uniform temperature, and metal tubes for heating the yarn, the tubes being totally immersed in the vessel and the yarn to be treated passing through these tubes.

In a practical embodiment, this device consists of two main horizontal vessels which are substantially parallel and are connected to one another by narrow substantially vertical channels, the lower vessel containing the heat transfer liquid and the heating devices and a metal tube, intended for the passage of the yarn, traversing the entire length of each vertical channel.

However, in the course of operation, especially if it is desired to run this device for a relatively long time, the vapour formed by the liquids of low boiling point, such as water, traces of which are present in the heat transfer liquid, condenses in the upper part of the upper horizontal vessel. This causes an irregular temperature distribution.

Furthermore, traces of gases which are non-condensable (methane, ethane and the like) at the operating temperature are also present in the vapour of the heat transfer fluid and these rapidly form a blockage in the upper part of the upper horizontal vessel, thus preventing the vapour of the hot heat transfer fluid from heating this part and from circulating freely. There is thus an abrupt temperature drop in the upper part of the treatment tubes, whilst it would be necessary that this part should be at least at the same temperature as all the upstream part of the tube. This, as stated, causes a drop in the temperature curve along the tube, which manifests itself in practice, as far as the yarn treated in this way is concerned, by a reduction in the bulk, a deterioration in dyeing affinity, and the appearance of streaks after dyeing.

In order to deal with these disadvantages, French Pat. No. 1,542,584 (corresponding to U.S. Pat. No. 3,395,433), U.S. Pat. No. 3,638,411 and French Pat. No. 2,176,284, have proposed, essentially, to locate, between the horizontal vessels, separating chambers which comprise a partition and a vapour return tube. This arrangement, which gives good results, however, suffers from the disadvantage of being complex and expensive, deteriorating in the long term and, finally, causing a large additional power consumption.

According to the present invention there is provided a yarn heating device comprising a lower vessel, a heat transfer liquid in said lower vessel, a heating device passing through said lower vessel to vaporise at least a part of said heat transfer liquid, an upper vessel, at least one conduit connecting the upper vessel to the lower vessel, at least one yarn treatment tube passing within said at least one conduit, for the passage of the moving yarn to be heated, and a metal portion, which is a very good heat conductor, surrounding the upper part only of said at least one treatment tube.

Such a heating device is easy to construct and it does not change in the course of operation, even of very long duration.

The enveloping part, made of a material which is a very good heat conductor, surrounds the end of the tube over a substantial length thereof. In an advantageous embodiment, the portion which is a very good conductor surrounds the tube from where it leaves the upper vessel over a substantial part of its path in the vertical channel.

In a preferred embodiment, the treatment tube is, as already stated, made of stainless steel or the like, and the surrounding portion is made of gold, silver, copper or, preferably, aluminium. Depending on whether what is concerned is a heating device (first oven) or a re-setting device (second oven) for a texturising process, the tube is respectively curved or straight.

In order that the invention will be more fully understood, the following description is given, merely by way of example, without implying any limitation, reference being made to the accompanying drawings, in which.

Figure 1:
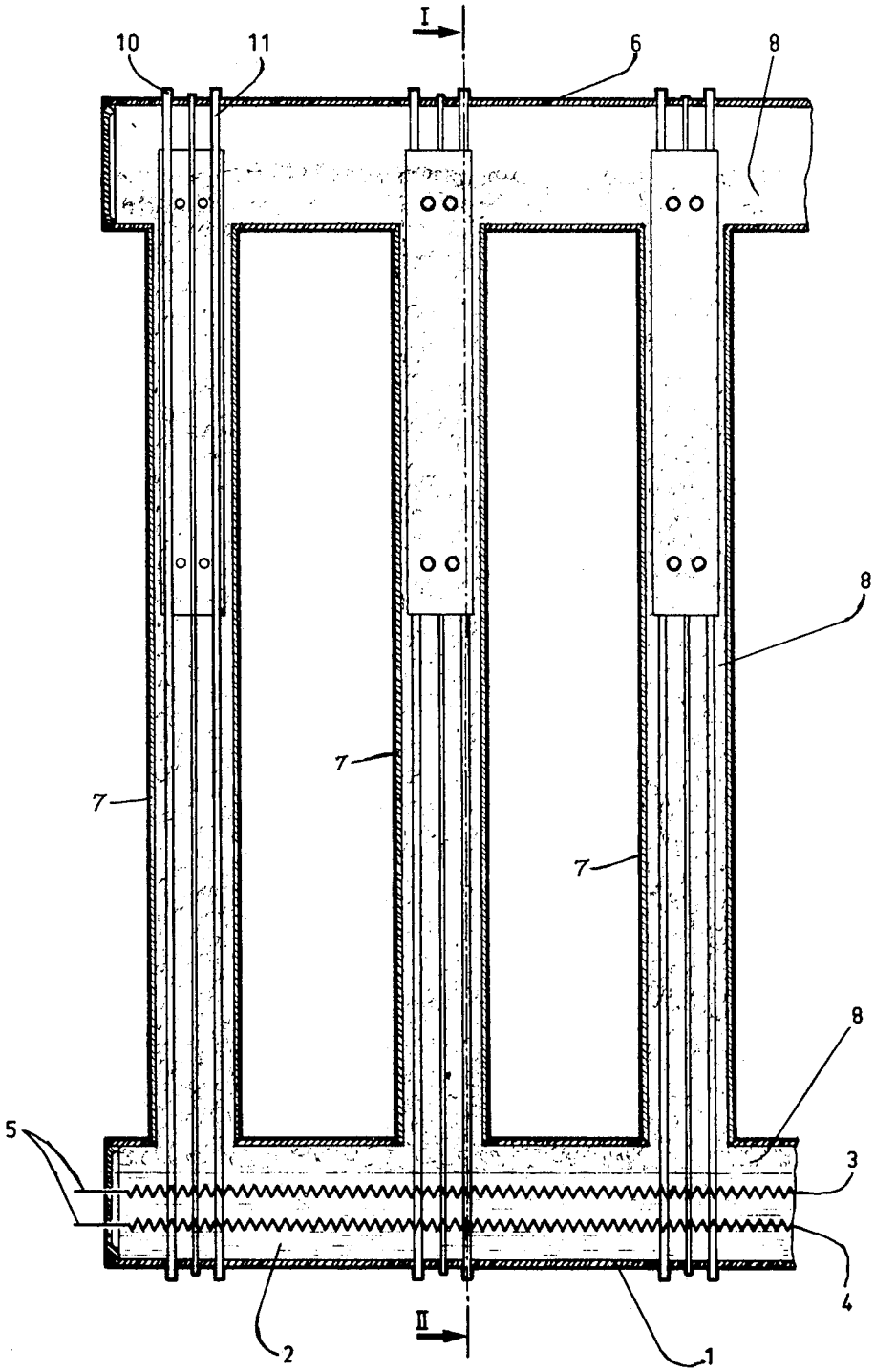
FIG. 1 is a schematic sectional front view of one embodiment of yarn heating device according to the invention.

The illustrated device is intended to form the first oven of a false-twist texturising machine, for example of type FTF 483, as sold by Ateliers Roannais de Construction Textile. This machine, or other machines of a similar type, are widely used and it is therefore not necessary to show it in the drawing, as the invention is limited to the design of the yarn heating device. As is known, each machine is composed of a plurality of yarn treatment positions arranged side-by-side, or even back-to-back, built onto the frames of different machines.

The heating oven consists essentially (see FIG. 1) of a lower horizontal tube 1, made of stainless steel and having the shape of an elongated cylinder, which contains a heat transfer liquid 2, of the diphyl type, which fills an appreciable part of the cylinder, a heating device intended to vaporise this liquid 2 and consisting of two electrical resistances 3 and 4 connected at their ends 5 to a conventional known source of current and system of controls, which are not shown, an upper horizontal tube 6, also made of stainless steel and in the shape of an elongated cylinder, and a group of vertical conduits 7 which connects the two tubes 1 and 6 together, these conduits also being made of stainless steel and being interiorly filled by the vapour 8 of the diphyl liquid 2 heated by the resistances 3 and 4.

In an advantageous embodiment, the pressure of the vapour 8 is less than atmospheric pressure, so that in the event of an accidental breakage in the installation, the hot liquid and/or the hot vapour do not tend to escape and to burn the operator or damage the adjacent equipment.

Through each vertical conduit 7 (see FIGS. 2 and 3) pass two curved tubes of stainless steel, 10 and 11, each intended to receive a moving yarn 12 and 13 respectively, and another, 14, which is also curved and made of stainless steel, but is of smaller diameter, and is intended to receive a heat-regulating probe, which is not shown. These tubes pass through the device from bottom to top, entering through the bottom of the tube 1, passing through the conduit 7 and emerging at the top of the upper tube 6.

The direction of travel of the yarn in the device is immaterial. It depends on the general design of the machine (whether the yarn travels downwards or upwards).

Figure 4:
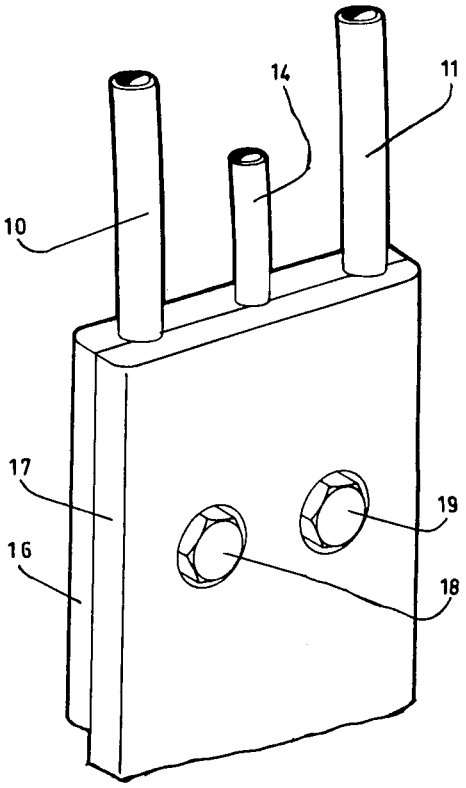
FIG. 4 is a perspective view of the end part of a treatment tube of the device of FIG. 1, covered by its conducting shell.

The end of the tubes is surrounded by a shell 15 made of aluminium and consisting of two component half-shells 16 and 17 joined to one another, by screws or similar means 18 and 19, so as to clamp around the component tubes (see FIG. 4).

The length of this shell 15, which extends as close as possible to the upper part of the upper tube 6 and extends into a substantial portion of the vertical channel 7 (see FIGS. 2 and 3) can vary in accordance with the effects desired.

Figure 2:
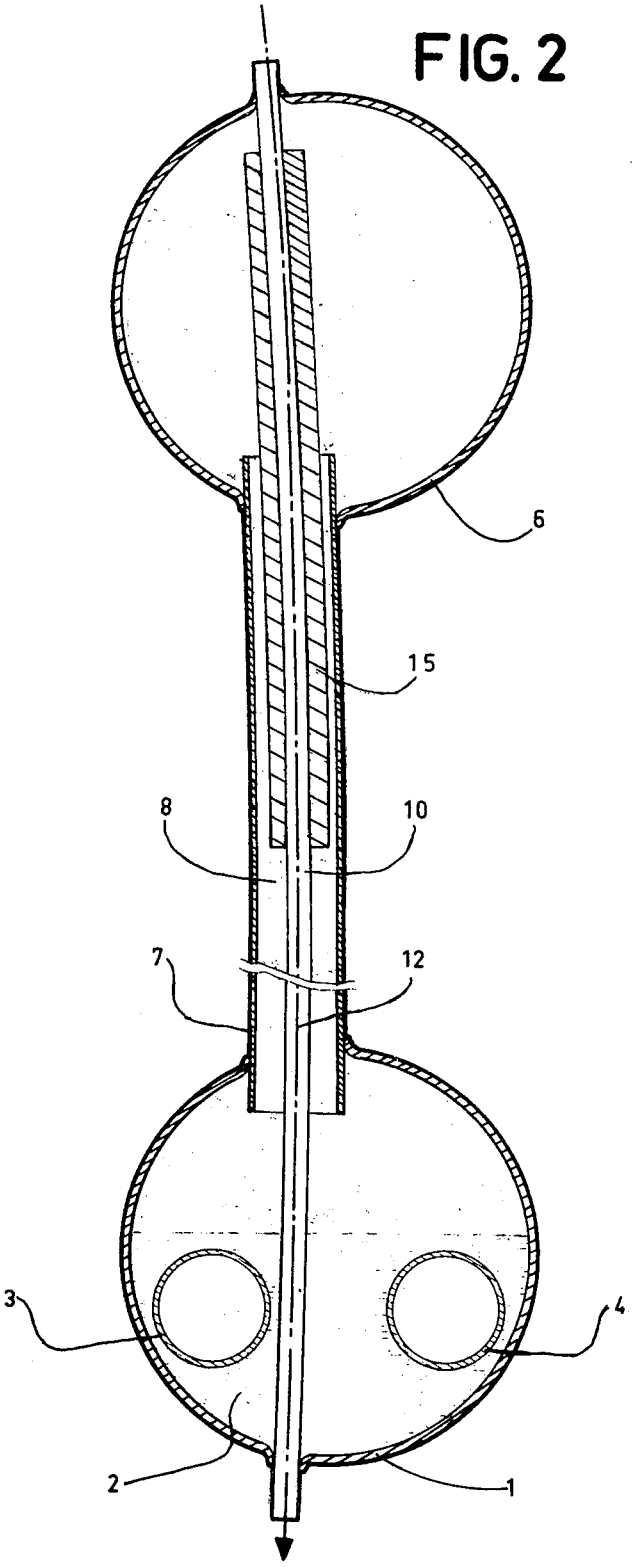
FIG. 2 is an enlarged transverse cross-section through the device of FIG. 1.
Figure 3:
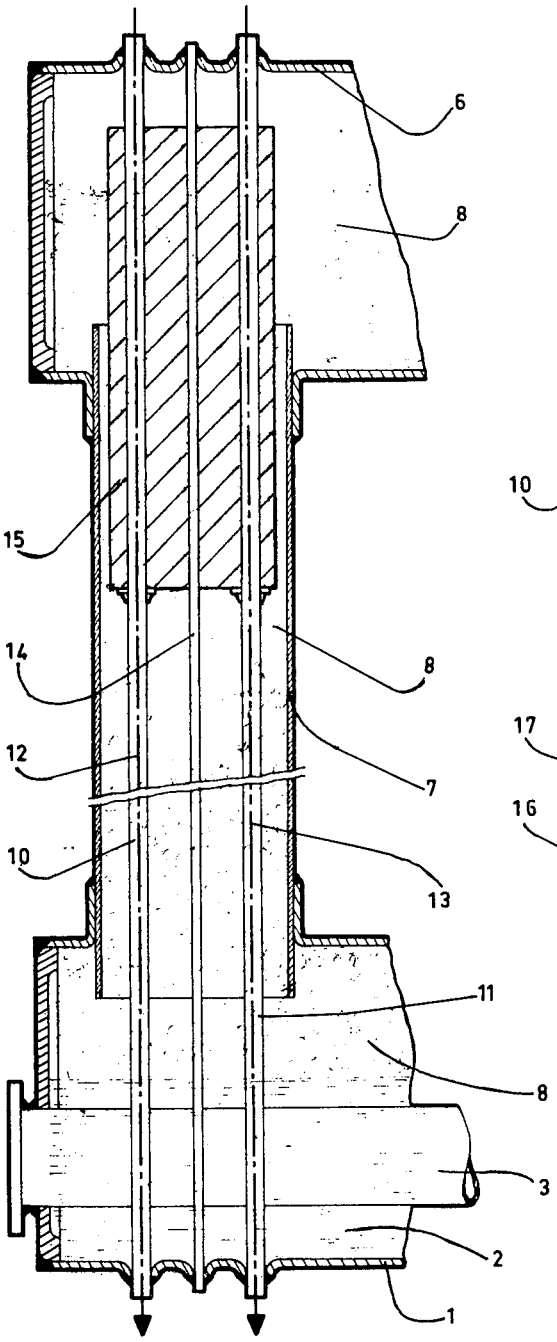
FIG. 3 is a more detailed cross-section of a portion of the device of FIG. 1.

This device functions as follows (FIG. 2). The resistances 3 and 4 bring the diphyl 2 to the boil and the resulting vapour 8, fills the whole of the upper part of the tube 6, the channels 7 and the tube 1.

If non-condensable gases form, these tend to accumulate in the upper part of the upper tube 6, which thus prevents the vapour 8 from circulating freely and from heating the upper extremity of the stainless steel tubes 10 and 11 to the same temperature as the remainder of these tubes, which are bathed by the vapour 8. The shell 15, which is a very good conductor of heat, then allows a part of the heat introduced at its lower level to travel to its upper level so as substantially to maintain the temperature constant along the entire length of the tubes 10 and 11.

In a particular embodiment, the curved tubes 10 and 11 are made of stainless steel and have an internal diameter of 8 millimetres, an external diameter of 9 millimetres, an arc height of 27 millimetres and a length of 150 centimetres; the shell 15 has a thickness of about 20 millimetres and a length of 250 millimetres.

In another embodiment, the length of the shell can be increased or reduced in accordance with the volume of the vaporising chamber.

In another modification, the conducting element can be moulded onto the tubes 10 or 11 or be assembled by any appropriate technique such as lamination, extrusion and the like.

We claim:

1. A yarn heating device comprising a lower vessel, a heat transfer liquid in said lower vessel, a heating device effective to vaporise at least a part of said heat transfer liquid, an upper vessel, at least one conduit connecting the upper vessel to the lower vessel, at least one yarn treatment tube passing within said at least one conduit for the passage of the moving yarn to be heated, and a metal heat conductive portion surrounding in thermal contact an upper part of said at least one treatment tube.

2. A yarn heating device as claimed in claim 1, wherein said metal portion surrounds said at least one yarn treatment tube from the point where it leaves the upper vessel downward over a substantial portion of its path in the conduit.

3. A yarn heating device according to claim 1, wherein said metal portion includes two joined half-shells which completely surround the upper ends of two parallel yarn treatment tubes.

4. A yarn heating device as claimed in claim 1, wherein said metal portion is made of aluminium.

5. A yarn heating device according to claim 1, wherein the vapour pressure of the heat transfer liquid at the operating temperature is less than atmospheric pressure.

6. A yarn heating device according to claim 1, wherein said heating device passes through said lower vessel over substantially the entire length of such vessel.

7. A yarn heating device comprising a first vessel adapted to hold a heat transfer liquid therein, a heating device passing through said first vessel effective to vaporise at least a part of the heat transfer liquid, a second vessel, at least one conduit connecting the first vessel to the second vessel, at least one yarn treatment tube passing within said at least one conduit for the passage of the moving yarn to be heated, and a metal portion of high heat conductivity surrounding in thermal contact the part of said at least one treatment tube proximate said second vessel.

8. A yarn heating device as claimed in claim 7, wherein said metal portion surrounds said at least one yarn treatment tube from where it leaves the second vessel over a substantial portion of its path in the conduit.

9. A yarn heating device according to claim 7, wherein said metal portion comprises two joined half-shells which completely surround the ends of two parallel yarn treatment tubes proximate said second vessel.

10. A yarn heating device as claimed in claim 7, wherein said metal portion is made of aluminium.

* * * * *